United States Patent [19]

Clark, Jr.

[11] 3,974,770

[45] Aug. 17, 1976

[54] SHOT CONTAINER FOR SHOTGUN CARTRIDGES

[75] Inventor: Homer E. Clark, Jr., Alton, Ill.

[73] Assignee: S & W Ammunition Company, Rock Creek, Ohio

[22] Filed: Aug. 26, 1974

[21] Appl. No.: 500,648

Related U.S. Application Data

[63] Continuation of Ser. No. 680,262, Nov. 2, 1967, abandoned, which is a continuation of Ser. No. 570,380, Aug. 4, 1966, abandoned, which is a continuation of Ser. No. 437,616, Feb. 11, 1965, abandoned, which is a continuation of Ser. No. 297,808, July 26, 1963, abandoned.

[52] U.S. Cl. ..... 102/42 C; 102/95

[51] Int. Cl.[2] ..... F42B 7/08

[58] Field of Search ..... 102/42, 42 C, 95

[56] References Cited

UNITED STATES PATENTS

| | | | |
|---|---|---|---|
| 395,879 | 1/1889 | Hartley et al. | 102/42 |
| 448,057 | 3/1891 | Long | 102/42 |
| 2,986,998 | 6/1961 | Clark, Jr. | 102/95 |
| 3,074,344 | 1/1963 | Devaux | 102/42 |
| 3,095,817 | 7/1963 | Clark, Jr. | 102/95 |
| 3,217,648 | 11/1965 | Foote et al. | 102/42 |
| 3,246,603 | 4/1966 | Comerford | 102/42 |
| 3,266,421 | 8/1966 | Comerford | 102/42 |
| 3,269,311 | 8/1966 | Comerford | 102/42 |

FOREIGN PATENTS OR APPLICATIONS

| | | | |
|---|---|---|---|
| 1,186,659 | 2/1959 | France | 102/42 C |
| 18,312 | 1903 | United Kingdom | |

OTHER PUBLICATIONS

Trap and Field Magazine, May, 1963, pp. 35–38.

*Primary Examiner*—Verlin R. Pendegrass
*Attorney, Agent, or Firm*—Ralph W. Kalish

[57] ABSTRACT

A wad column for shotgun cartridges having a thin-walled shot container portion with narrow elongated openings extending longitudinally of the shot container portion and frangible means located at the ends of the openings.

6 Claims, 9 Drawing Figures

INVENTOR.
HOMER E. CLARK, JR.
BY Ralph W. Kalish
ATTORNEY

SHOT CONTAINER FOR SHOTGUN CARTRIDGES

This application is a continuation of application Ser. No. 680,262, filed Nov. 2, 1967, now abandoned; which application in turn is a continuation of application Ser. No. 570,380, filed Aug. 4, 1966, now abandoned; which application in turn is a continuation of application Ser. No. 437,616, filed Feb. 11, 1965, now abandoned; which application in turn is a continuation of application Ser. No. 297,808, filed July 26, 1963, now abandoned.

This invention relates, in general, to shotgun cartridges, and more particularly, to a shot container therefor.

It is an object of the present invention to provide a preformed container for the shot charge in shotgun cartridges which protects such charge, minimizing shot deformation normally caused by shot scrubbing against the gun barrel.

It is a further object of the present invention to provide a preformed container of the character stated which serves to cushion and hold the shot charge in a cohesive manner so as to conduce to relatively dense shot patterns, substantially eliminating the erratic flight encountered with deformed shot.

It is an additional object of the present invention to provide a preformed shot container for shotgun cartridges composed of a plurality of sections adapted for parting upon explosion so that upon emission from the gun barrel the said sections will separate from the shot, thereby eliminating blown patterns.

It is a still further object of the present invention to provide a wad column which integrally incorporates a shot container portion incorporating sections separable upon explosion; which wad column thus conduces to facility of loading in that the wads and shot may be unitarily inserted within the cartridge casing.

It is another object of the present invention to provide a shot container of the character stated which may be adapted for use with various shot sizes; which is primarily designed for utilization by individuals who load their own shells; and which may be reliably seated within a shell casing in proper operative relationship by use of the customary wad ram.

Other objects and details of the invention will be apparent from the following description, when read in connection with the accompanying drawing wherein -

Figure 1:
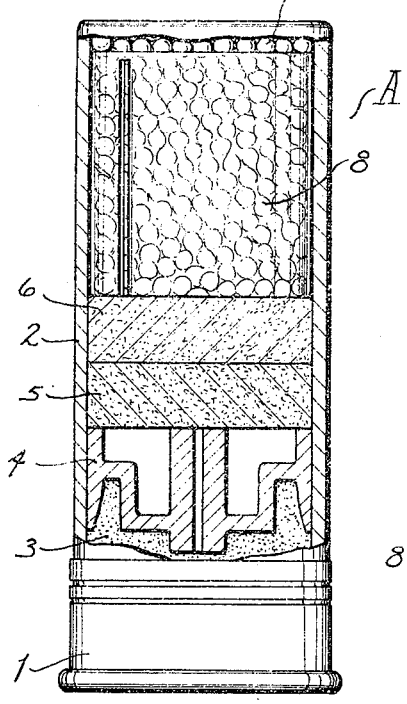
FIG. 1 is a side view of a shotgun cartridge, a portion of the body wall being broken away, incorporating a shot container constructed in accordance with and embodying the present invention.
Figure 2:
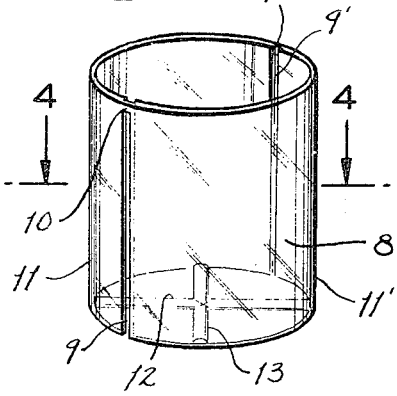
FIG. 2 is a perspective view of the shot container.
Figure 3:
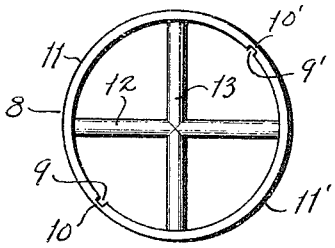
FIG. 3 is a top plan view of the shot container.
Figure 4:
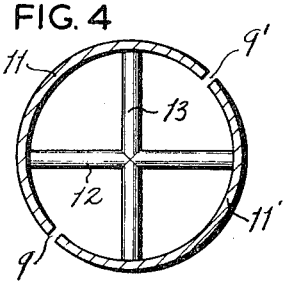
FIG. 4 is a horizontal transverse sectional view taken on the line 4—4 of FIG. 2.

Referring now by reference characters to the drawing, which illustrates practical embodiments of the present invention, A designates a shotgun shell, or cartridge, having a base 1 and the usual tubular body or casing 2 fabricated as of paper, metal or the like. A primer assembly (not shown) is disposed within base 1 and thereabove within body 2 is presented a propellant charge 3. In immediately overlying and confining relationship to propellant charge 3, there is provided an obturating wad 4; there being the usual filler wads, such as, 5 and 6 disposed above said obturating wad 4. It is obvious that obturating wad 4 may be replaced by any suitable wad column, since the particular wads utilized in cartridge A do not form a part of the present invention and those shown are set forth merely for purposes of illustration. Superimposed upon filler wads 5, 6 is the shot charge 7, preferably of multi-missile character which is confined within a preformed shot container 8, to be described more fully hereinbelow. The upper end of shall A may be closed in any customary manner, such as, by a top wad or by folding the tube wall inwardly upon itself.

Shot container 8 is formed from suitable light weight plastic having relative toughness, such as polyethylene, and being preferably of molded construction, amenable to economical, high volume production. Said shot container 8 is of thin-walled tubular or cylindrical form, being annular in cross section and having an outside diameter substantially the same as the inside diameter of cartridge casing 2 for facile fitted disposition therein. Container 8 is provided with a pair of diametrically opposed, narrow, elongate openings, 9,9' extending through the wall of container 8 and substantially the height thereof, with their lower ends at the bottom of said container wall and their upper ends terminated proximate the upper end edge of said container 8 by narrow necks 10,10' of reduced thickness relative to the container wall to provide zones of weakness or frangibility for purposes presently appearing. Thus, shot container 8 is substantially divided by openings 9,9' into two complementary sections 11,11' which at their upper ends are joined by said necks 10,10' and at their lower ends are interconnected by means of a pair of integrally formed X-forming cross braces 12,13.

As is evident from the above, shot container 8 is adapted for ease of handling since by its unitary structure it may be easily inserted into cartridge casing 2 during loading operation, as by utilization of a conventional wad ram, for support upon the underlying filler wads 5,6. With shot container 8 so disposed, the user, such as an individual loader, may then dispense the appropriate shot into container 8 and then effect closure of the adjacent end of the cartridge casing in any conventional manner.

Upon firing of cartridge A, the explosion will immediately effect rupture of necks 10,10' so that upon emission of container 8 from the gun barrel, the normally upper portions of sections 11,11' will move away from each other or separate, thereby opening for unimpeded shot discharge therefrom, whereby elimination of interference with the shot is effected and the likelihood of blown patterns is obviated. It will be seen that the shot charge is protected by shot container 8 so that scrubbing of the shot against the gun barrel is substantially prevented, thereby inhibiting the shot deformation customarily caused by such scrubbing action. Container 8 thus cushions the shot and holds the shot charge cohesively together so that a markedly increased pattern density is brought about with expected greater firing accuracy. By retaining the shot charge until discharge from the gun in a relatively unitary manner, shot container 8 is productive of substantially longer, effective shot range. Consequently, shot container 8 conduces to speed and efficiency in loading, as by individuals, as well as causing recognized improvements in shotshell operations.

Figure 5:
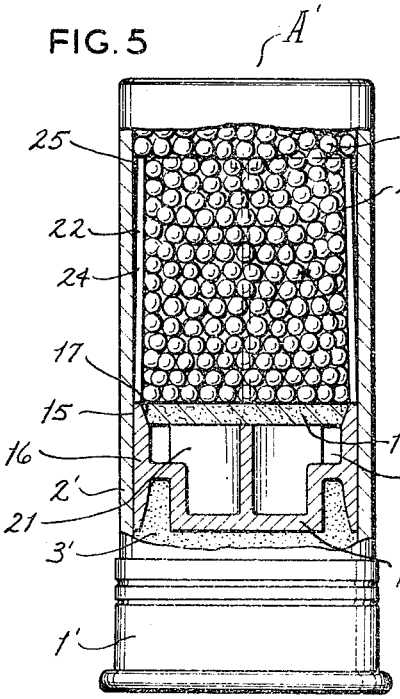
FIG. 5 is a side view of a shotgun cartridge, a portion of the body wall being broken away, incorporating a wad column constructed in accordance with and embodying the present invention.
Figure 6:
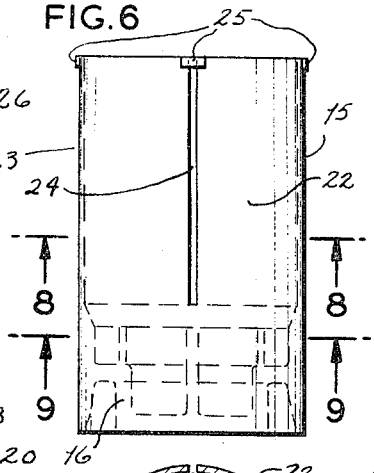
FIG. 6 is a side elevational view of the wad column.
Figure 7:
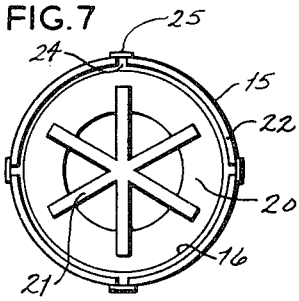
FIG. 7 is a top plan view of the wad column.
Figure 8:
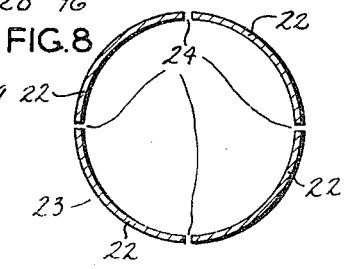
FIG. 8 is a horizontal transverse sectional view taken on the line 8—8 of FIG. 6.
Figure 9:
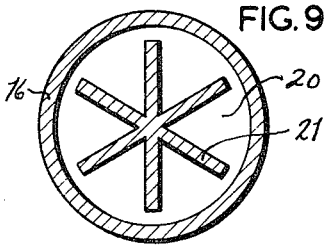
FIG. 9 is a horizontal transverse sectional view taken on the line 9—9 of FIG. 6.

Referring now to FIG. 5, A′ designates a shotgun shell or cartridge having a base 1′ and the usual tubular body or casing 2′ fabricated as of paper material or the like. A primer assembly (not shown) is disposed within base 1′ and thereabove, within body 2′, is presented a propellant charge 3′ in immediately overlying and confining relationship to which is presented a wad column indicated generally 15 which is produced by any suitable means such as by molding as from a suitable plastic for high volume manufacture.

Wad column 15 is of basically cylindrical configuration and is relatively elongatd with its length comparable to the composite length of a conventional obturating wad, customary filler wads and the shot charge. Said wad column 15 integrally incorporates at its lower or propellant-adjacent end an obturating wad-defining portion 16 having the exterior configuration of the obturating wad set forth and described in United States Pat. No. 2,986,998. The wall of said wad column 15 at the upper end of obturating wad portion 16 is internally beveled as at 17 for wedgingly receiving a filler wad 18 which cooperates with the base wall 19 of obturating wad portion 16 and the intervening side wall sections of the wad column to define a compartment 20. Provided within compartment 20 is a series of relatively thin fins or partition-like members, radiating from the longitudinal axis of said compartment 20 and being in general stellar-formation. Said fins 21 extend the length of said compartment 20, from base wall 19 to wad 18 which latter abuts on its under surface against the upper end edges of said fins 21. Fins 21 are free at their outer end edges which terminates spacedly from the wad column wall so that compartment 20, in effect, constitutes a continuous air cell.

Above beveled portion 17, wad column 15 incorporates a relatively thin, elongated annular wall 22 which defines a shot container portion indicated generally at 23, the lower end of which is determined by filler wad 18 and the upper end of which is open. Shot container portion 23 is provided with a plurality of equi-spaced, narrow openings 24, the axes of which are parallel to the axis of wad column 15 and which extend from the lower end of shot container portion 23 to the upper end thereof. Bridging each opening 24 at its upper end is a narrow, thin tab 25, the ends of which are suitably adhered to the outer face of the adjacent portions of wall 22; which tabs 25 thus project slightly beyond the exterior face of said wall 22. Tabs 25 are of reduced thickness relative to the thickness of wall 22 for easy breakability, thus, being in the nature of "break-away" tabs which serve the same function as necks 10,10′ of shot container 8 hereinabove described.

With wad column 15 inserted within cartridge casing 2′ by conventional means, the loader will then fill shot container portion 23 with shot 26 of desired size, with the shot extending beyond the normal upper edge of shot container portion 23. The adjacent or upper end of cartridge A′ is then closed as by crimping, or in any other customary manner. Upon firing, wad 18 will tend to buckle or bulge downwardly in its central portion, due to the compressive forces exerted thereon, which action will tend to collapse fins 21 which, as stated above, are relatively thin and are, hence, quite compressible. Upon the collapsing of fins 21, wad 18 will extend inwardly within compartment 20, thereby substantially reducing the volume thereof. Such downward buckling of wad 18 will permit shot 26 to follow same and drop downwardly (as the cartridge is viewed in FIG. 5) so that the shot 26 presented above shot container portion 23 during loading will be received within wall 22 for containment and guidance by the shot container portion 23. Thus, compartment 20 provides a cushioning effect through its air cell character. Upon firing, tabs 25 would immediately rupture. However, walls 22 prevent scrubbing action between shot 26 and the gun barrel wall and, thus, shot is properly contained during progress through the gun barrel. Upon discharge from the gun nozzle, the various sections of the wall 22 of shot container portion 23 are free to separate and, as the same are no longer secured to each other by means of the now-broken tabs 25, shot container portion 23 will open at its outer end to allow free, unimpeded movement of the shot therethrough with like results as obtained through utilization of shot container 8 above described.

Thus, wad column 15 unitarily incorporates the novel aspects of a shot container adapted for appropriate opening upon emission from a gun and an air cell being designed to provide a cushioned effect upon firing; and by the use of which a relatively increased amount of shot may be utilized. It should be particularly noted that since fins 21 terminate in their outer portions from the wall of the obturating wad portion 16, there is no possibility of obstruction to their collapsing on firing. Nor, will the same have a tendency to pull the side walls inwardly.

Wad column 15 thus presents a unit which may be easily and reliably used by individuals who do their own re-loading and the use of which provides various and numerous benefits in gunnery hereinabove described.

It is important to point out that the wedging of filler wad 18 against the beveled inner walls of wad column 15 causes an outward force being created against the walls of said wad column 15 which, thus, assures of wad column 15 maintaining a compression upon the powder. Heretofore, with plastic wads there has been the problem of causing filler wads to maintain position since normally the same, after having been placed into position by a seating wad ram, will tend to unseat. Thus, by the present wedging action, the said walls will be forced outwardly against the cartridge casing and thereby assure of the maintenance of pressure against the powder.

It should be understood that changes and modifications in the formation, construction, arrangement, and combination of the several parts of the Shot Container for Shotgun Cartridges may be made and substituted for these herein shown and described without departing from the nature and principle of my invention.

Having thus described my invention, what I claim and desire to secure by letters patent is -

1. For use with a shotgun cartridge, a wad column comprising an elongated, cylindrical body, an obturating wad portion being provided at one end of said wad column, a relatively thin-walled shot container portion being provided in the other end portion of said wad column, the end of said shot container portion remote from said obturating wad portion being open, the end of said obturating wad portion remote from said shot container portion being closed and defining with adjacent body portion of said column an inner compartment normally continuous with the interior of the shot container portion, a wad seated within said wad column for defining the inner limit of the shot container portion and being in planer parallel relationship to the closed end of said obturating wad portion for completing enclosure of said compartment, a plurality of thin, frangible fins disposed in said compartment and in normal abutting relationship on one edge to the said wad, said shot container portion having a plurality of narrow elongated openings extending longitudinally of the shot container portion, and frangible means provided adjacent the ends of said elongated openings, the open end of said shot container portion.

2. For use with a shotgun cartridge, a wad column as defined in claim 1 and further characterized by said narrow elongated openings extending throughout the length of the shot container portion, and frangible tabs extending across said openings adjacent the end of said shot container portion.

3. For use with a shotgun cartridge, a wad column as defined in claim 1 and further characterized by said frangible fins being spaced at their outer ends from the confronting portion of the compartment.

4. For use with a shotgun cartridge, a wad column as defined in claim 3 and further characterized by said shot container portion having a plurality of narrow elongated openings extending longitudinally of the shot container portion, and frangible means provided adjacent the ends of said openings and the open end of said shot container portion.

5. For use with a shotgun cartridge, a wad column as defined in claim 1 and further characterized by said fin members projecting radially from the longitudinal axis of the cylindrical body, and said fins being of the same height as said compartment.

6. For use with a shotgun cartridge, a wad column comprising an elongated, cylindrical body, an obturating wad portion being provided at one end of said wad column, a relatively thin-walled shot container portion being provided in the other end portion of said wad column, the end of said shot container portion remote from said obturating wad portion being open, wad means provided within said column between said obturating wad portion and said shot container, said shot container portion having a plurality of narrow elongated openings extending longitudinally of the shot container portion, and frangible means provided adjacent the ends of said elongated openings proximate the open end of said shot container portion.

* * * * *